US005928053A

United States Patent [19]

Henderson

[11] Patent Number: 5,928,053

[45] **Date of Patent: *Jul. 27, 1999**

[54] AMUSEMENT DEVICE AND METHOD FOR PROPELLING WATER FROM A BODY OF WATER

[76] Inventor: Darryl G. Henderson, 105 Runnymede Ave., Apt. B5, Wayne, Pa. 19087

[ * ] Notice: This patent issued on a continued prosecution application filed under 37 CFR 1.53(d), and is subject to the twenty year patent term provisions of 35 U.S.C. 154(a)(2).

[21] Appl. No.: 08/632,617

[22] Filed: Apr. 19, 1996

[51] Int. Cl.[6] ..... A63H 23/00

[52] U.S. Cl. ..... 446/153; 446/176; 446/475; 417/572

[58] Field of Search ..... 446/153, 176, 446/475; 415/120; 417/572

[56] References Cited

U.S. PATENT DOCUMENTS

| | | | |
|---|---|---|---|
| 2,954,736 | 10/1960 | Garland | 417/572 |
| 3,091,453 | 5/1963 | Bennett | 446/153 |
| 4,067,500 | 1/1978 | Stevenson | 417/572 |
| 4,116,108 | 9/1978 | Hyman . | |
| 4,235,378 | 11/1980 | Melin et al. | 446/153 |
| 4,925,181 | 5/1990 | Anderson | 272/1 B |
| 5,009,413 | 4/1991 | Allen | 472/128 |
| 5,288,256 | 2/1994 | Lee | 446/48 |
| 5,433,646 | 7/1995 | Tarng | 446/473 |

FOREIGN PATENT DOCUMENTS

| | | | |
|---|---|---|---|
| 3917167 | 11/1990 | Germany | 446/475 |

OTHER PUBLICATIONS

"Super Doodle", brochure, Feb. 1996.

*Primary Examiner*—Kien T. Nguyen
*Assistant Examiner*—Jeffrey D. Carlson
*Attorney, Agent, or Firm*—LaMorte & Associates P.C.

[57] ABSTRACT

An amusement device for propelling water either from a self contained reservoir or from a standing body of water. The amusement device is a type of toy whip that uses a whipping action to propel water toward a target. The amusement device contains a tubular handle and at least one flexible tubular element that extends from one end of the tubular handle, thereby forming an overall tubular structure having a rigid section and a flexible section. By partially submerging the tubular handle in a body of water and manipulating the overall tubular structure with a whipping action, water is drawn up into the tubular structure. The flexible tubular element extending from the handle tapers toward a small exit aperture. As the whipping motion of the overall tubular structure forces water toward the exit aperture, the water becomes compressed by the taper of the flexible tubular element. As a result, the water is propelled from the exit aperture at a high rate of speed. As long as the handle of the amusement device remains partially submerged, water will continuously be drawn into the device as needed.

12 Claims, 4 Drawing Sheets

AMUSEMENT DEVICE AND METHOD FOR PROPELLING WATER FROM A BODY OF WATER

BACKGROUND OF THE INVENTION

1. Field of the Invention

The present invention is an amusement device and method for manually propelling a volume of water toward a desired target from a standing body of water, such as a pool. More specifically, the present invention relates to devices that retain a volume of water and propel that water as a result of the amusement device being manually manipulated by a user.

2. Description of the Prior Art

There are many amusement devices in existence that enable a person to propel a volume of water toward a target using manual energy. Many such devices take the form of water guns, wherein a relatively small volume of water is propelled toward a target in a short period of time. A characteristic of many traditional water guns is that the range of the water gun is relatively short. Since the stream of water propelled by a water gun has a small volume, the stream of water is also heavily influenced by wind resistance and cross winds that prevent the propelled water from reaching the intended target across longer distances. Accordingly, the cohesive stream of water originally emitted by a water gun breaks apart while being propelled toward a distant target. As a result, at the outer range of a traditional water gun, a target may only receive a few drops of water.

There are many physical limitations that require traditional water guns to propel a narrow stream of water instead of rapidly emptying their reservoirs all at once. One such limitation is the fact that the reservoir carried by a traditional water gun is fairly small. By limiting the output volume of the water gun, the effective life of the water reservoir is extended. However, often in water amusement games, the objective of the game is not to reserve your water supply. Rather, in many games, the objective is to get your opponent as wet as possible in as short a period of time as possible. A second limitation is that many traditional water guns use the energy from a finger or hand manipulated pump to propel water toward a target. Often the energy available from such a manually manipulated pump is only sufficient enough to propel a small volume of water toward a target. As such, the physical limitations of the water propelling mechanisms in traditional water guns do not enable the water gun to discharge its reservoir in a rapid fashion.

In an attempt to increase the volume of water an amusement device can deliver in a short period of time, amusement devices have been developed that use water filled projectiles. Such prior art devices are exemplified by U.S. Pat. No. 5,433,646 to Tarng, entitled WATER GUN LAUNCHING WATER GRENADE and U.S. Pat. No. 5,288,256 to Lee et al., entitled THROWN WATER PROPELLING AND DISPENSING TOY. Such prior art amusement devices are capable of delivering a fairly large volume of water to a distant target. However, by using a projectile filled with water, a projectile with a significant bulk mass is also being delivered at the target. Consequently, if the target were a person, the possibility of injury exists if the person is struck by the projectile.

U.S. Pat. No. 4,925,181 to Anderson, entitled SWIMMING POOL WATER CANNON, shows yet another approach used in the art for delivering a large volume of water at a target. In the Anderson patent, a hollow frustrum-shaped amusement device is provided having handles on its sides. A person sitting or standing in a body of water can rapidly pull the larger end of the frustrum-shaped amusement device into the body of water. As a result, water within the frustrum-shaped amusement device rushes toward the small end of the amusement device and is propelled into the air.

The problems associated with the amusement device described in the Anderson patent include the fact that the operator of the amusement device must position himself/herself in a body of water of a significant depth. This alone prevents the Anderson device from being used in a game where the object of the game is to keep dry. Additionally, the Anderson device requires a significant amount of manipulation and time between firing cycles. As such, opponents can easily advance during the period between firing cycles when the Anderson device is incapable of propelling water.

It is therefore an objective of the present invention to provide an amusement device that is capable of delivering a large volume of water at a distant target without the use of a projectile.

It is another objective of the present invention to provide an amusement device that can automatically supply itself with water from a body of water, when used near the surface of the body of water.

It is yet another objective of the present invention to provide an amusement device as stated above that is low cost, easy to manufacture and has a rapid firing cycle.

These objectives are met by the present invention as described and claimed below.

SUMMARY OF THE INVENTION

The present invention is an amusement device for propelling water either from a self contained reservoir or from a standing body of water. The amusement device is a type of toy whip that uses a whipping action to propel water toward a target. The amusement device contains a tubular handle and at least one flexible tubular element that extends from one end of the tubular handle, thereby forming an overall tubular structure having a rigid section and a flexible section. By partially submerging the tubular handle in a body of water and manipulating the overall tubular structure with a whipping action, water is drawn up into the tubular structure. The flexible tubular element extending from the handle tapers toward a small exit aperture. As the whipping motion of the overall tubular structure forces water toward the exit aperture, the water becomes compressed by the taper of the flexible tubular element. As a result, the water is propelled from the exit aperture at a high rate of speed. As long as the handle of the amusement device remains partially submerged water will continuously be drawn into the device as needed, while the whipping action is occurring.

In a preferred embodiment, a one-way valve is disposed within the tubular handle. The one-way valve permits the flow of water into the tubular handle from the bottom of the tubular handle and prohibits water from flowing out of the bottom of the tubular handle. As a result, water can be drawn into the tubular handle from a body of water and then the tubular handle can be removed from the body of water. The tubular handle retains the water until the overall tubular structure is manipulated through a whipping action and the stored water is discharged.

BRIEF DESCRIPTION OF THE DRAWINGS

For a better understanding of the present invention, reference is made to the following description of two exemplary embodiments thereof, considered in conjunction with the accompanying drawings, in which.

DETAILED DESCRIPTION OF THE DRAWINGS

Figure 1:
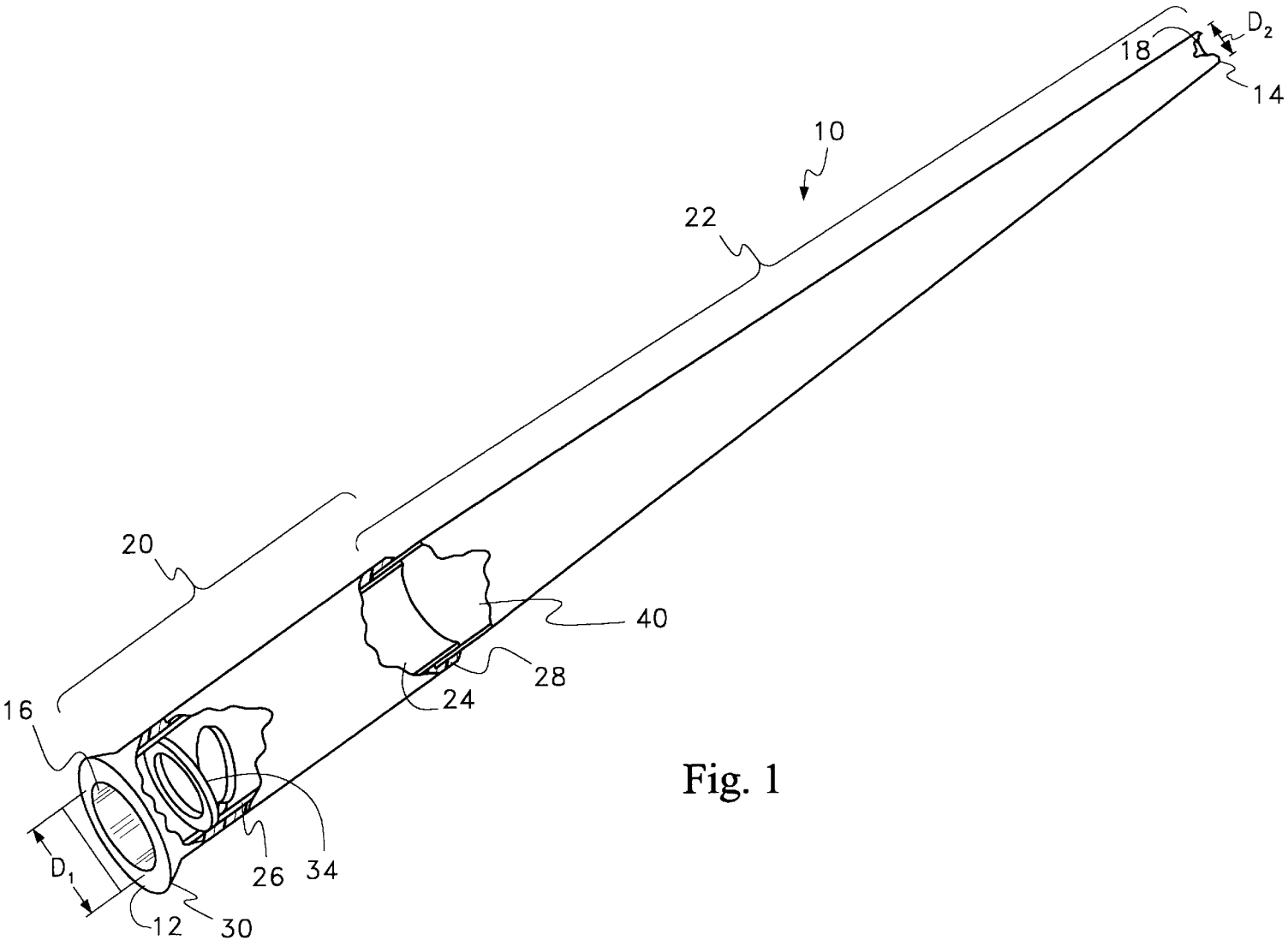
FIG. 1 is a selectively fragmented perspective view of one preferred embodiment of the present invention amusement device.

Referring to FIG. 1, there is shown an exemplary embodiment of an amusement device 10 made in accordance with the present invention. In the shown embodiment, the amusement device 10 is a tubular structure having an open bottom end 12 and an open top end 14. The aperture 16 defined by the bottom end 12 has a diameter D1 which is larger than the diameter D2 of the aperture 18 defined by the open top end 14.

The amusement device 10 has a handle region 20 that extends from the open bottom end 12 and a whip region 22 that extends from the handle region 20 to the open top end 14. The handle region 20 defines an open interior 24 having a volume of up to one liter. The interior 24 of the handle region 20 preferably has a circular cross-section and is formed by a piece of base tubing 26 that is rigid enough to resist being deformed when the handle region 20 is firmly grasped and manipulated by a person's hand. In the shown embodiment, the base tubing 26 within the handle region 20 is surrounded by a tubular piece of foam rubber 28 or similar material such as cork, styrofoam or the like, that makes the handle region 20 easy to grasp when wet. The thickness of the foam rubber 28 is also selected to provide buoyancy to the overall amusement device 10, wherein the handle region 20 of the amusement device 10 would float to the surface of the water should the amusement device 10 ever be dropped into the water. In the shown embodiment, the foam rubber 28 expands into a flange 30 proximate the open bottom end 12 of the amusement device 10. The flange 30 helps prevent the handle region 20 from slipping out of a user's hand when the amusement deice 10 is in use, as will later be explained.

A one-way valve 34 is located within the interior 24 of the handle region 20 proximate the open bottom end 12. The one-way valve 34 is oriented in such a manner so that the one-way valve 34 permits the flow of water through the handle region 20 from the open bottom end 12 toward the open top end 14, but prevents water from flowing in the opposite direction. In the shown embodiment, the one-way valve 34 is a flap valve. However, it should be understood that any other type of one-way valve known in the art can also be used.

The whip region 22 of the amusement device 10 is made from flexible material that enables the whip region 22 to readily bend when the handle region 20 is shaken. In the shown embodiment, the whip region 22 tapers from the point where the whip region 22 engages the handle region 20 down to the open top end 14. The whip region 22 defines an interior 40 that also tapers. At the point where the whip region 22 engages the handle region 20, the interior 40 of the whip region 22 has a diameter close to that of the bottom aperture 16. The diameter of the whip region 22 then evenly tapers along its length until the interior 40 achieves the diameter D2 of the aperture 18 in the open top end 14. Preferably, the large end of the whip region 22 is affixed to the exterior of the base tubing 26 contained within the handle region 20. By using such an attachment structure, a smooth, unrestricted transition occurs between the interior 24 of the handle region 20 and the interior 40 of the whip region 22.

As will later be explained, the present invention amusement device 10 can be used either by a person in a body of water or by a person with access to a body of water. In both situations, the method for propelling the water toward a target remains the same. However, as will be described, the method of supplying water to the amusement device 10 differs.

Figure 2:
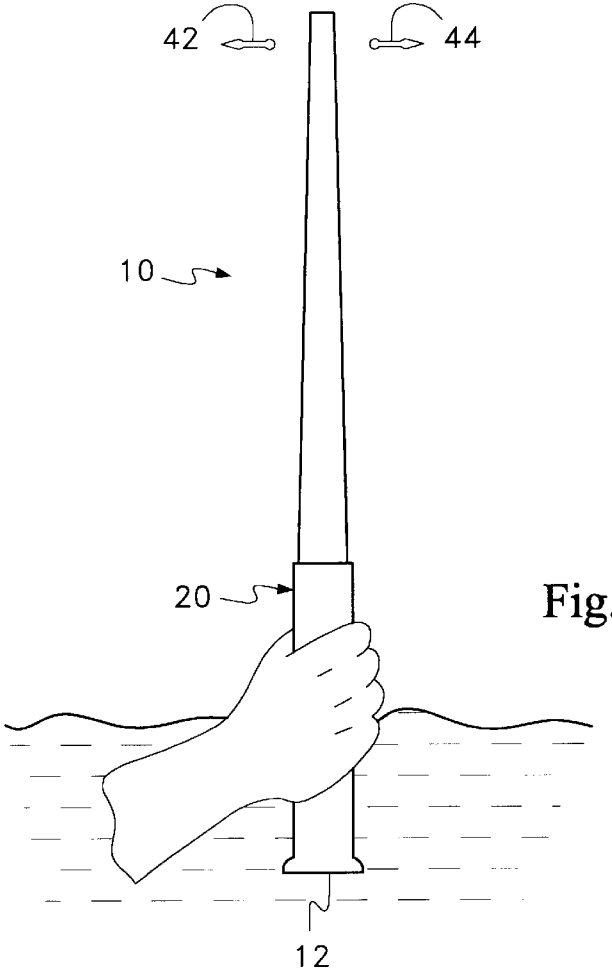
FIG. 2 is a front view of the embodiment of FIG. 1 shown in conjunction with a body of water to illustrate one method of use for the present invention amusement device.

Referring to FIG. 2, a first method of use for the amusement device 10 is shown, where the user is positioned in a body of water such as a pool, a lake or in the ocean. To use the amusement device 10, the handle region 20 is grasped and the amusement device 10 is held so that the open bottom end 12 of the handle region 20 is submerged. The person holding the handle region 20 then begins to move his/her wrist with a whipping action, thereby causing the opposite open top end 14 to rapidly move back and forth in the directions of arrow 42 and arrow 44.

Figure 3:
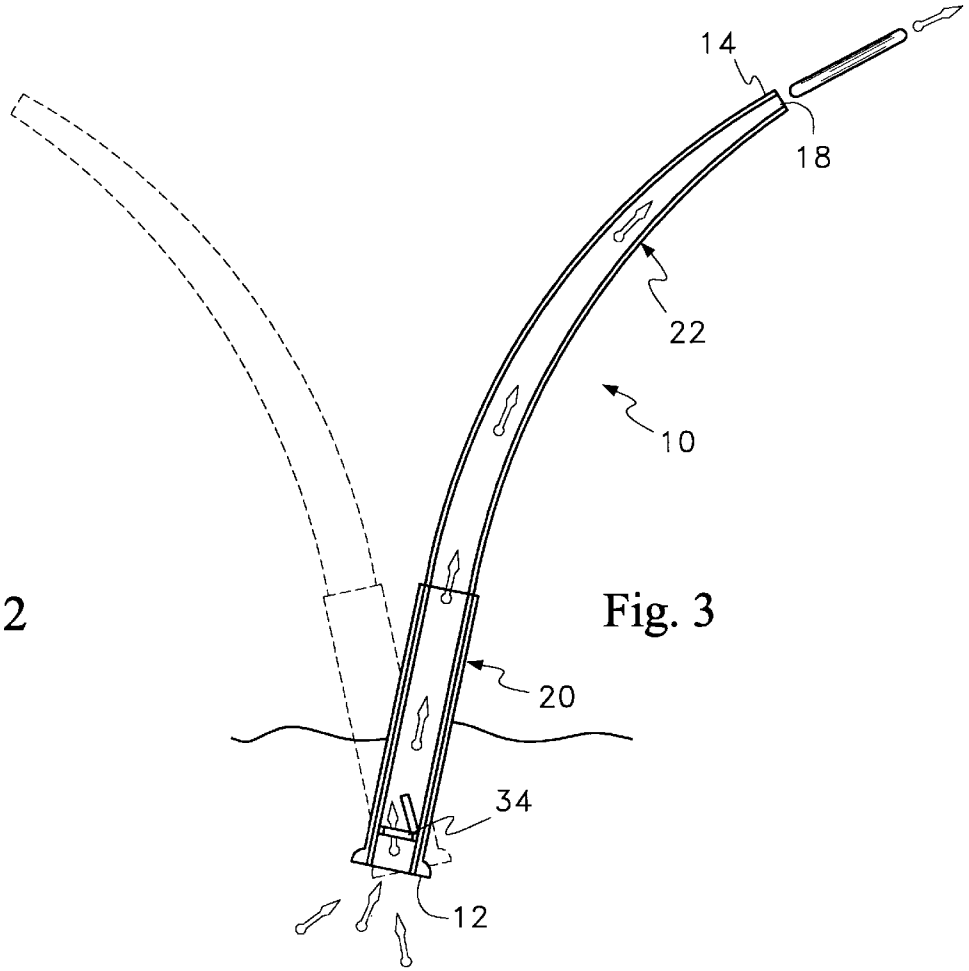
FIG. 3 is a cross-sectional view of the embodiment of FIG. 2 shown during use.

Referring to FIG. 3, it can be seen that as the handle region 20 is rapidly moved back and forth, the whip region 22 of the amusement device 10 bends and moves widely between an advanced position (shown) and a retracted position (shown with hidden lines). As the whip region 22 is whipped to the advanced position, the air passing the rapidly moving open top end 14 creates a low pressure within the whip region 22 in accordance with the Venturi principal. The low pressure draws water up into the whip region 22, wherein centripetal force and momentum assist the water in moving toward the narrow aperture 18 at the open top end 14. Since the whip region 22 tapers toward the aperture 18 at the open top end 14, the water become increasingly confined within the whip region 22 as the water approaches the aperture 18 at the open top end 14. Water is therefore propelled from the aperture 18 at the open top end 14 each time the whip region 22 reaches the advanced position. Depending upon how rapidly the handle region 20 is manipulated by a user, the whip region 22 can reach the advanced position a few times each second. Also, by moving the whip region 22 toward the advanced position more rapidly than moving the whip region 22 into the retracted position, a person can make the amusement device 10 propel water only during the forward stroke, i.e. when the whip region 22 is moved to the advanced position.

As the water is propelled from whip region 22, water is simultaneously drawn into the amusement device 10 through the open bottom end 12. The one-way valve 34 permits the flow of water up into the amusement device 10. As a result, the amusement device 10 automatically draws the water it needs from the body of water in which it is partially submerged. As long as the amusement device 10 is rapidly cycled between the advanced position and the retracted position, water will continue to be propelled.

Figure 4:
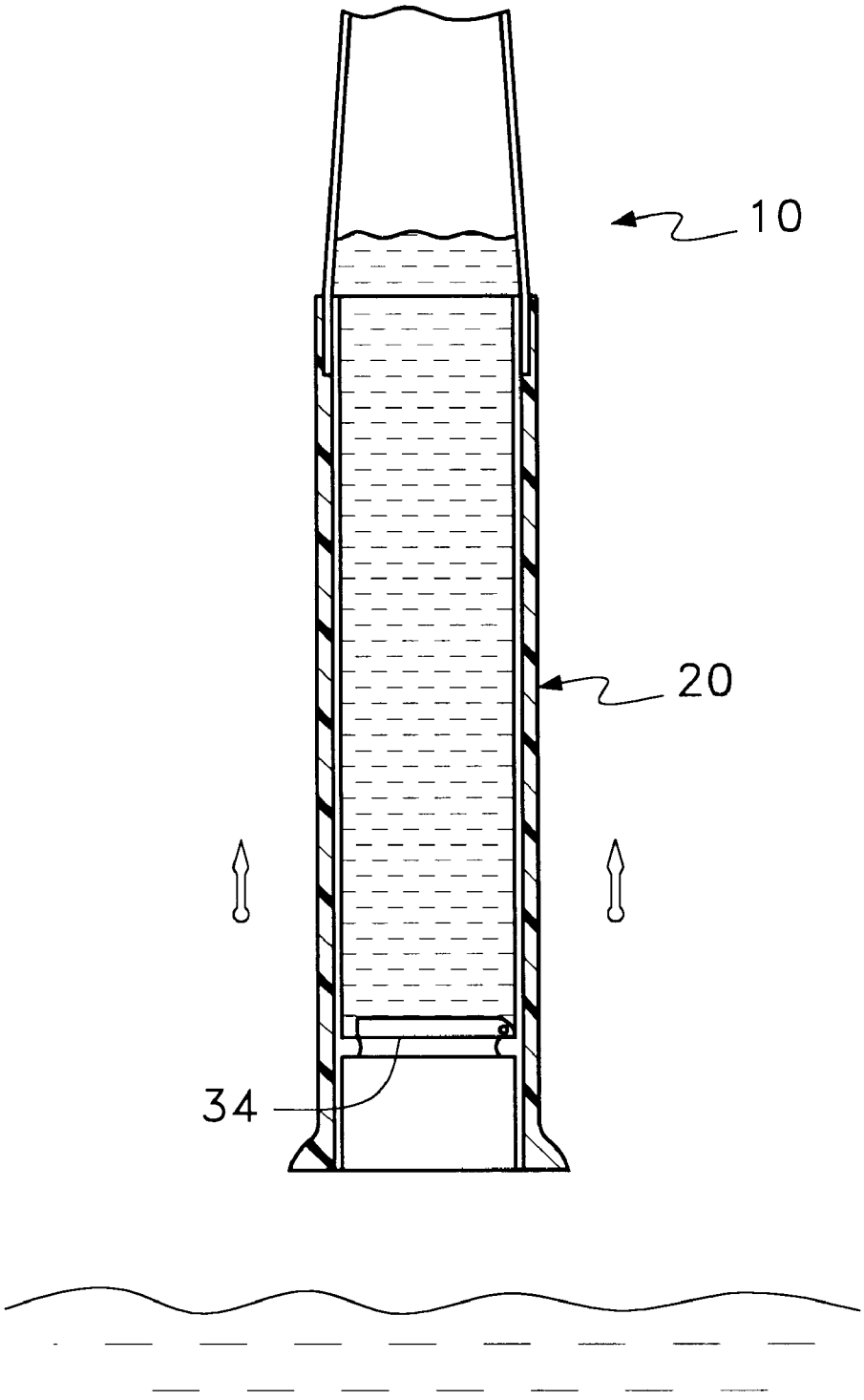
FIG. 4 is a cross-sectional view of the handle section of the embodiment of FIG. 1, shown retaining a volume of water to illustrate a second method of use for the present invention amusement device.

The present invention amusement device 10 can also be used at a location remote from a source of water. Referring to FIG. 4, it can be seen that once the amusement device 10 is filled with water, the weight of the water closes the one-way valve 34, thereby trapping the water within the confines of the amusement device 10. The amusement device 10 can therefore be carried by a person far away from the source of water used to fill the amusement device 10. Once a target has been located, the amusement device 10 can be rapidly moved to an advanced position with a whip action, as has previously been described. The rapid movement of the amusement device 10 causes the water stored in the amusement device 10 to move toward the aperture 18 (FIG. 1) at the open top end 14 (FIG. 1) of the amusement device 10. The upward movement of the water within the amusement device 10 lowers the pressure within the amusement device 10, thereby causing the one-way valve 34 to open. As the one-way valve 34 opens, air is vented into the interior of the amusement device 10 below the upwardly surging water. As a result, the water is free to flow from the aperture 18 at the open top end 14 without concern of a partial vacuum forming within the confines of the amusement device 10.

Each time the amusement device 10 is rapidly manipulated to an advanced position, some of the water held within the amusement device 10 is discharged from the aperture 18 (FIG. 1) at the top end 14 (FIG. 1) of the amusement device 10. Depending upon the size of the aperture 18, between two and ten firing cycles can be had with the amusement device 10 before the water supply stored within the amusement deice 10 is depleted.

To refill the amusement device 10, water is either poured through the aperture 18 (FIG. 1) at the open top end 14 (FIG. 1) of the amusement device 10 or the handle region 20 of the amusement device 10 is submerged in a body of water. When the handle region 20 of the amusement device 10 is submerged, the one-way valve 34 opens and water is free to flow into the amusement device 10. Once the handle region 20 is lifted out of the water, the weight of the water within the amusement device 10 causes the one-way valve 34 to close, thereby storing a volume of water within the amusement device 10.

Figure 5:
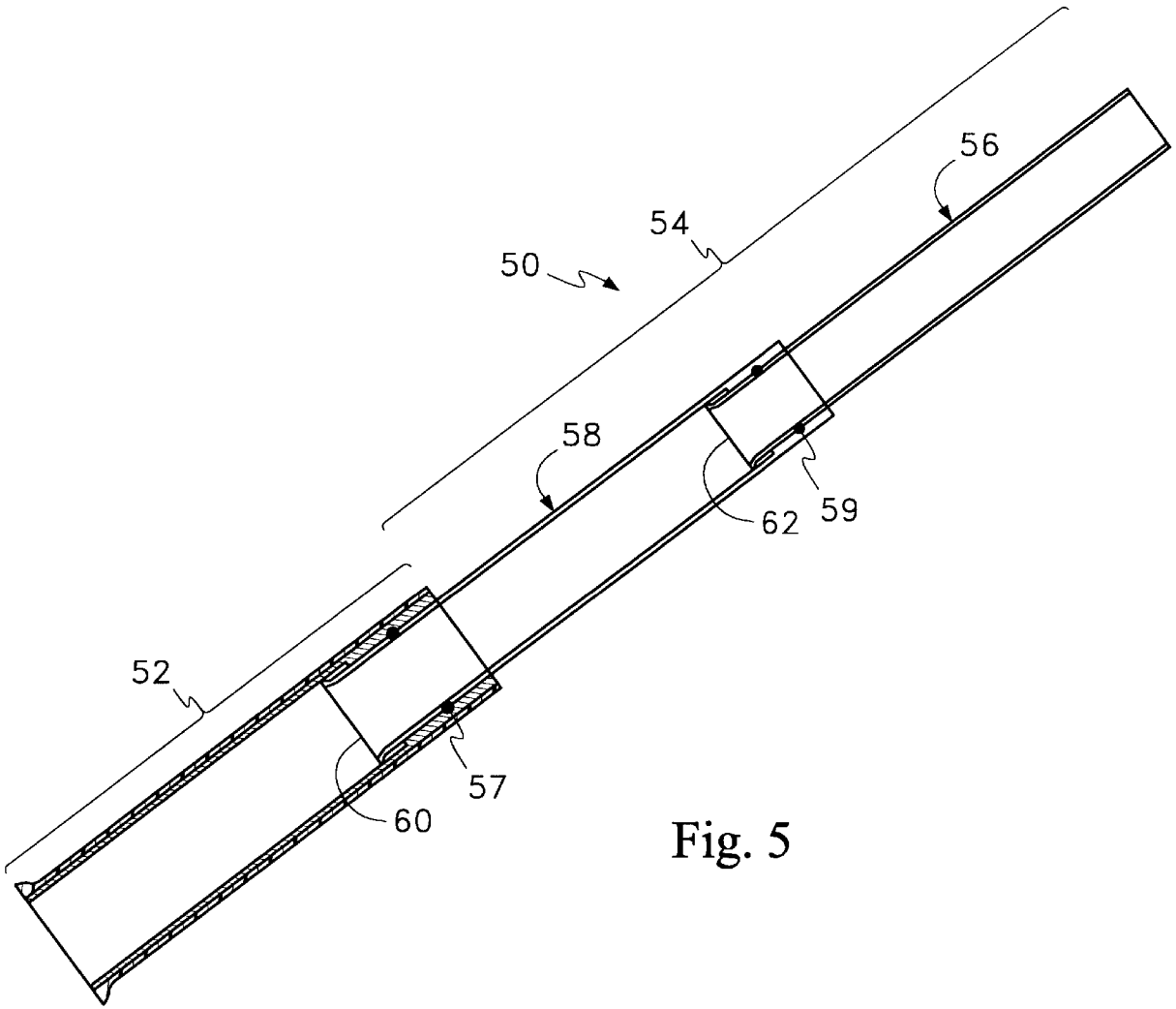
FIG. 5 is a cross-sectional view of an alternate embodiment of the present invention amusement device.

Referring to FIG. 5, an alternate embodiment of an amusement device 50 is shown in accordance with the present invention. The amusement device 50 has a handle region 52 and a whip region 54. However, the whip region 54 is comprised of two tubular elements 56, 58 that are telescopically connected to each other and to the handle region 52. As such, the first tubular element 56 can be retracted into the second tubular element 58 and both tubular elements 56, 58 can be retracted into the handle region 52.

The handle region 52 is sized to receive the second tubular element 58 therein. An O-ring 57 is disposed on the interior of the handle region 52 to create a water impermeable seal between the handle region 52 and the second tubular element 58. The interior of the second tubular element 58 is tapered proximate the end 60 of the second tubular element 58 that enters the handle region 52. The taper provides a smooth transition between the interior of the handle region 52 and the interior of the second tubular element 58, thereby not significantly obstructing the flow of water between the handle region 52 and the second tubular element 58.

The second tubular element 58 is sized to receive the first tubular element 56. An O-ring 59 is disposed on the interior of the second tubular element 58 to create a water impermeable seal between the second tubular element 58 and the first tubular element 56. The interior of the first tubular element 56 is tapered proximate the end 62 of the first tubular element 56 that enters the second tubular element 58. The taper provides a smooth transition between the interior of the second tubular element 58 and the interior of the first tubular element 56, thereby not significantly obstructing the flow of water between the second tubular element 58 and the first tubular element 56.

The telescopic construction of the amusement device 50 enables the whip region 54 to be retracted into the handle region 52 when the amusement device 50 is not being used. The whip region 54 of the amusement device 50 can be extended to its full operating length by snapping the handle region 52 forward with a whipping action. By such a manipulation, centripetal force and momentum would cause the first tubular element 56 and the second tubular element 58 to move to their fully extended positions and the amusement device 50 is ready for use.

In the embodiment of FIG. 5, no one-way valve is present within the handle region 52. As has been previously explained, when the amusement device 50 is held partially submerged in a body of water, the movement of the amusement device 50 automatically will cause water to be drawn into the handle region 52. As such, a one-way valve is not needed in the application of the present invention amusement device 50 now being illustrated. Rather, a one way valve is only required when water is to be retained within the amusement device as the amusement device is carried to a point remote from a source of water.

It will be understood that the embodiments of the present invention amusement device specifically illustrated and described are merely exemplary and the present invention can be practiced using many alternate embodiments. It will also be understood that a person skilled in the art can modify the exemplary embodiments by substituting alternate components for those specifically described. All such alternate embodiments and modifications are intended to be included within the scope of the present invention as set forth in the appended claims.

What is claimed is:

1. An amusement device for propelling water, comprising:

a tubular handle having a first open end and an opposite second open end, wherein said tubular handle defines a first interior space that extends between said first open end and said second open end;

at least one flexible tubular element having an open proximal end of a first diameter and an open distal end of a smaller second diameter, said at least one flexible tubular element defining a tapered second interior space that continuously tapers downwardly from said proximal end to said distal end, wherein said proximal end of said at least one flexible tubular element is coupled to said second open end of said tubular handle and said first interior space directly communicates with said second interior space to define a continuous open interior space between said first open end of said tubular handle and said distal end of said at least one flexible tubular element; and a one-way valve disposed within said rigid tubular handle, wherein said one-way valve only permits a flow of water through said first interior space from said first open end toward said second open end.

2. The device according to claim 1, wherein said first open end of said tubular handle defines an opening of a first size and said second open end of said tubular handle defines an opening of a second size that is smaller than said first size, wherein said first interior spaces tapers downwardly from said first open end to said second open end.

3. The device according to claim 1, wherein said tubular handle is rigid.

4. The device according to claim 1, wherein said at least one tubular element is telescopically coupled to said tubular handle, thereby enabling said at least one tubular element to be retracted into said tubular handle.

5. The device according to claim 1, wherein said at least one tubular element is a single tubular element that extends from said proximal end to said distal end.

6. The device according to claim 4, wherein said at least one tubular element includes a plurality of tubular elements that are telescopically coupled together.

7. A toy whip device for throwing water, comprising:

a handle having a first end, a second end and a water reservoir disposed between said first end and said second end;

a one-way valve disposed within said handle, wherein said one-way valve only permits a flow of water through said water reservoir from said first end toward said second end; and a flexible length of tapered tubing that tapers continuously in a uniform manner from a wide end to an opposite narrow end, said flexible length of tapered tubing being coupled to said handle, wherein said wide end of said flexible length of tapered tubing communicates with said water reservoir, and water from said water reservoir travels through said flexible length of tapered tubing to said opposite narrow end when said toy whip device is manipulated with a whipping action.

8. The device according to claim 7, further including an aperture in said water reservoir, wherein said aperture enables air to flow into said water reservoir when said device is manipulated with a whipping action and water is moved from said water reservoir into said flexible length of tapered tubing.

9. The device according to claim 7, wherein said handle is buoyant and is capable of causing all of said device to float in water.

10. The device according to claim 7, wherein said tubing is telescopically coupled to said handle, thereby enabling said tubing to be positioned between a retracted position where said tubing is at least partially retracted into said handle and an extended position where said tubing fully extends from said handle.

11. The device according to claim 10 wherein said tubing is free moving with respect to said handle and moves from said retracted position to said extended position when said device is manipulated with a whipping action.

12. The device according to claim 11, wherein said tubing includes a plurality of telescoping sections that extend into a fully extended condition when said device is manipulated with a whipping action.

* * * * *